US006084578A

United States Patent [19]

Hiroki

[11] Patent Number: 6,084,578

[45] Date of Patent: Jul. 4, 2000

[54] DEVICE FOR GENERATING DRIVE SIGNAL OF MATRIX DISPLAY DEVICE

[75] Inventor: Masaaki Hiroki, Kanagawa, Japan

[73] Assignee: Semiconductor Energy Laboratory, Co., Ltd., Kanagawa-Ken, Japan

[21] Appl. No.: 08/993,662

[22] Filed: Dec. 18, 1997

[30] Foreign Application Priority Data

Dec. 19, 1996 [JP] Japan ..... 8-354311

[51] Int. Cl.[7] ..... G09G 3/36

[52] U.S. Cl. ..... 345/204; 345/87

[58] Field of Search ..... 345/204, 205, 345/206, 211, 212, 213, 87, 88, 89, 98, 100, 99, 132

[56] References Cited

U.S. PATENT DOCUMENTS 5,734,378 3/1998 Okada et al. ..... 345/204

5,923,322 7/1999 Kim ..... 345/204

*Primary Examiner*—Xiao Wu

*Attorney, Agent, or Firm*—Fish & Richardson P.C.

[57] ABSTRACT

To provide an apparatus of easily generating drive signals in correspondence with various display systems in a test device of a matrix type display device or the like, a drive signal in correspondence with each display system is generated by using at least a module for inputting an image signal, a synchronizing signal and the like, a module for subjecting the image signal to time division and a module for generating a clock signal, even when a display device to be tested is changed, a drive signal corresponding thereto can simply be generated by changing combinations of the modules or changing programs in the modules, exchanging a sequencer chip or the like and higher degree of test and analysis can be performed by adding modules for correcting the image signal, a control module or the like.

22 Claims, 9 Drawing Sheets

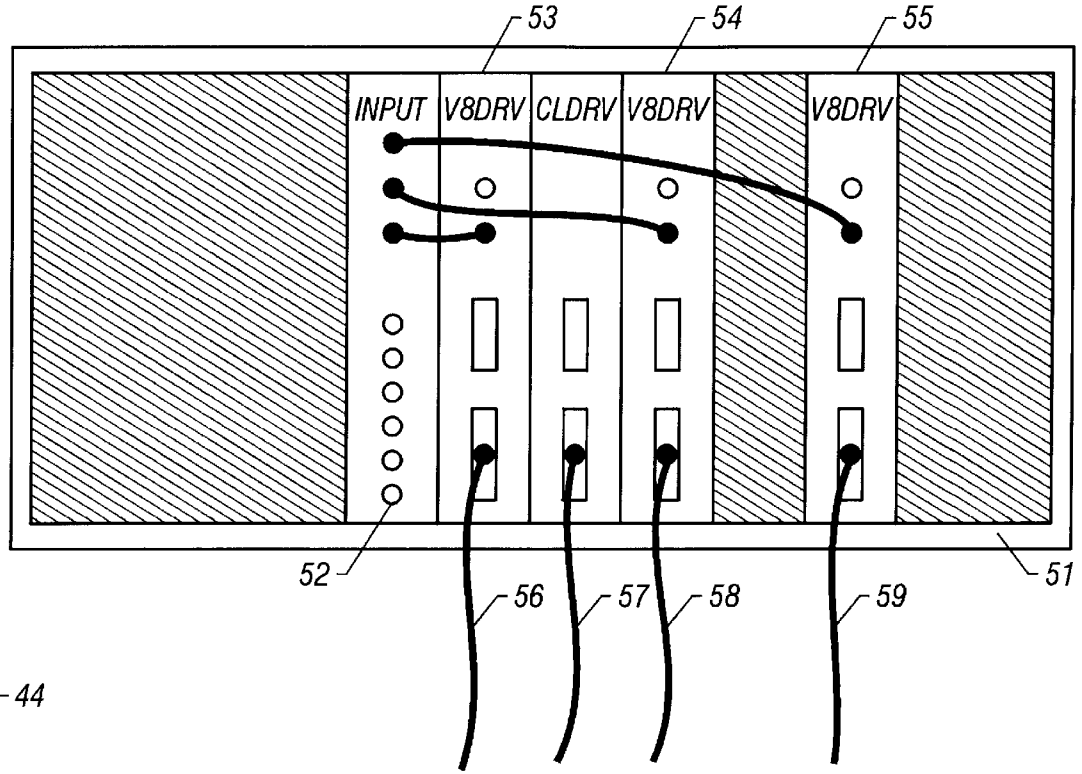
FIG. 5
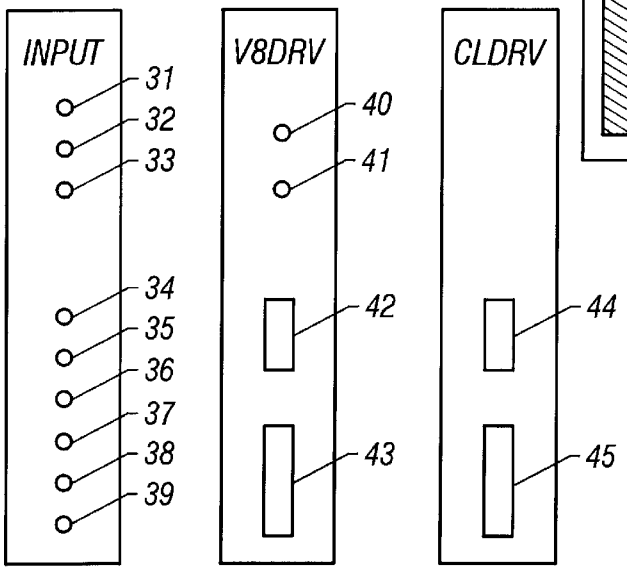
FIG. 4A
FIG. 4B
FIG. 4C

DEVICE FOR GENERATING DRIVE SIGNAL OF MATRIX DISPLAY DEVICE

BACKGROUND OF THE INVENTION

1. Field of the Invention

The present invention disclosed in this specification relates to the constitution of an apparatus suitable for generating signals for driving matrix type display devices of various types, display capacities and methods of display (for example, active matrix type liquid crystal display device).

2. Description of the Related Art

In recent years various matrix display devices are known. The most familiar one is a liquid crystal display device in which a simple (passive) display device and an active matrix display device are included. These devices can perform displaying operation by inputting an image signal and a clock (synchronizing) signal from outside. However, in respect of types of signals, there are various types in accordance with display devices and a normal signal needs to be modified and inputted in accordance therewith. This point differs significantly from a cathode ray tube (CRT) which is a typical conventional display device.

For example, an explanation will be given of an active matrix type display device as an example. FIGS. 10A and 10B show a monolithic type active matrix display device having an active matrix portion 84, a data driver circuit 82 and a scan driver circuit 83 on a substrate 81 where these circuits are formed at same plane of the substrate. However, even when the driver circuit is formed by a semiconductor chip, the explanation of the present invention remains unchanged.

The structure designated by FIG. 10A is of the simplest monochromatic display including a synchronizing signal input (CLOCK IN) and a video signal input (VIDEO IN) as input terminals. The structure is similar to that of a normal monochromatic CRT. (FIG. 10A)

Further, as shown by FIG. 10B, the structure of color display is provided with a synchronizing input (CLOCK IN) and video signal inputs (VIDEO IN B, G, R) in correspondence with three primary colors. The structure is similar to that of a normal color CRT. (FIG. 10B)

However, according to a matrix display device, input terminals other than these are provided and therefore, there are devices which need different drive signals.

For example, according to the structure shown by FIG. 11A, although the device is of a monochromatic display, a synchronizing signal input (CLOCK IN) and a first through a fourth video signal input (VIDEO IN 1–4) are provided as input terminals. In a normal CRT, a number of inputs of video signals is only one in the monochromatic display, however, according to a matrix display device, there are cases where the video signal is divided into a plurality of signals in this way which are inputted simultaneously for the purpose of lowering processing speed of signals. (FIG. 11A)

Further, according to the structure shown by FIG. 11B, although the device is similarly of the monochromatic display, a first and a second synchronizing signal input (CLOCK IN 1 and 2) and a video signal input (VIDEO IN) are provided as input terminals. According to a normal CRT, a number of inputs of synchronizing signals is only one, however, in a matrix display device, there are cases where a plurality of synchronizing signals phases of which are shifted from each other in this way are used and signal processing circuits (for example, shift registers 86 and 87) respectively in correspondence thereto are provided for the purpose of lowering processing speed of signals. (FIG. 11B)

Similarly, according to the structure shown by FIG. 11C, a color display matrix having two routes of shift registers and dividing each of image signals in four, is provided with a first and a second synchronizing signal input (CLOCK IN 1 and 2) and a first through a fourth video signal input (VIDEO IN R1–4, G1–4, B1–4) for each of three primary colors. (FIG. 11C)

For example, a data driver of a matrix display device having two routes of shift registers and performing display operation by video signals divided in eight, is provided with the structure shown by FIG. 12. Further, FIG. 13 shows pulse signals (for driving analog sample hold) outputted from shift registers A1 and B1, a video signal before division and signals after division inputted to a first, a fourth and a ninth video signal line. (FIG. 12, FIG. 13)

As described above, according to the matrix display device, various display methods are requested in accordance with the constitution of circuit and the like. Further, there are such a variety of display methods (that is, drive signals) and accordingly, in performing inspection of various matrix display devices, it is necessary to remake circuits for generating drive signals for respective matrix display device. For example, a drive signal suitable for a display device shown by FIG. 10A can not drive the display devices shown by FIG. 11A and FIG. 11B to carry out normal display.

However, to make a drive circuit for each of matrix display devices needs time and expense and hinders efficient operation. The present invention has been carried out in view of the above-described points and it is an object of the present invention to provide an apparatus capable of simply changing necessary drive signals in matrix display devices.

SUMMARY OF THE INVENTION

The present invention disclosed in this specification is featured in that signals for driving a matrix display device are generated by using the following three modules. That is,

- a first module for inputting an image signal and a synchronizing signal (input module),
- a second module for subjecting the image signal to time division (image signal module), and
- a third module for generating a clock signal (clock module).

These modules are independent from each other. The second module is featured in capable of arbitrarily setting a number of divisions of an image signal. For that purpose, a chip (sequencer chip) for controlling the setting operation may be exchanged or a programmable chip using a rewritable element of EPROM, EEPROM or the like may be used. Further, output and phase of the clock signal of the third module may by changed.

Various types of signals can be generated by combinations of the above-described modules. Further, a module having other function may be added. For example, there are a module (correction module, for example, γ correction module) for correcting in compliance with initially set information, a module functioning as an interface (interface module) for connecting to a computer, a module for inputting and outputting a control signal from outside (control module), a module (trigger module) for connecting to an inspection circuit of an oscilloscope or the like, and so on.

When these modules can be used by inserting into a main frame 1 as shown by FIG. 2, wiring is facilitated. FIG. 1 shows a state where various modules are inserted into the main frame 1. That is, there are from left a control module 2, an interface module 3, γ correction modules 4–6, an input module 7, an image module 8, a clock module 9, an image module 10, a clock module 11, an image module 12, a clock module 13 and a trigger module 14. (FIG. 1, FIG. 2)

The main frame is provided with for example, a power source common bus lines (particularly, clock distribution and timing synchronizing signals), which can be electrically connected to a back portion of the modules through connect pins. Also, each module is constituted with a sub-frame and at least one circuit board on which a circuit is provided.

Naturally, in using the main frame, the main frame needs not always to be filled with the modules but, for example, as shown by FIG. 3, may be in a state where a main frame 21 is inserted with from left an input module 22, image modules 23 and 24, a clock module 25, image modules 26 and 27, a clock module 28, and image modules 29 and 30 and nothing is inserted thereto on the left side of the input module. (FIG. 3)

BRIEF DESCRIPTION OF THE DRAWINGS

FIGS. 4A, 4B and 4C show front faces of an input module, an image module and a clock module according to Embodiment 1;

FIG. 5 shows an example of connecting respective modules according to Embodiment 1;

DETAILED DESCRIPTION OF THE PREFERRED EMBODIMENTS

Figure 1:
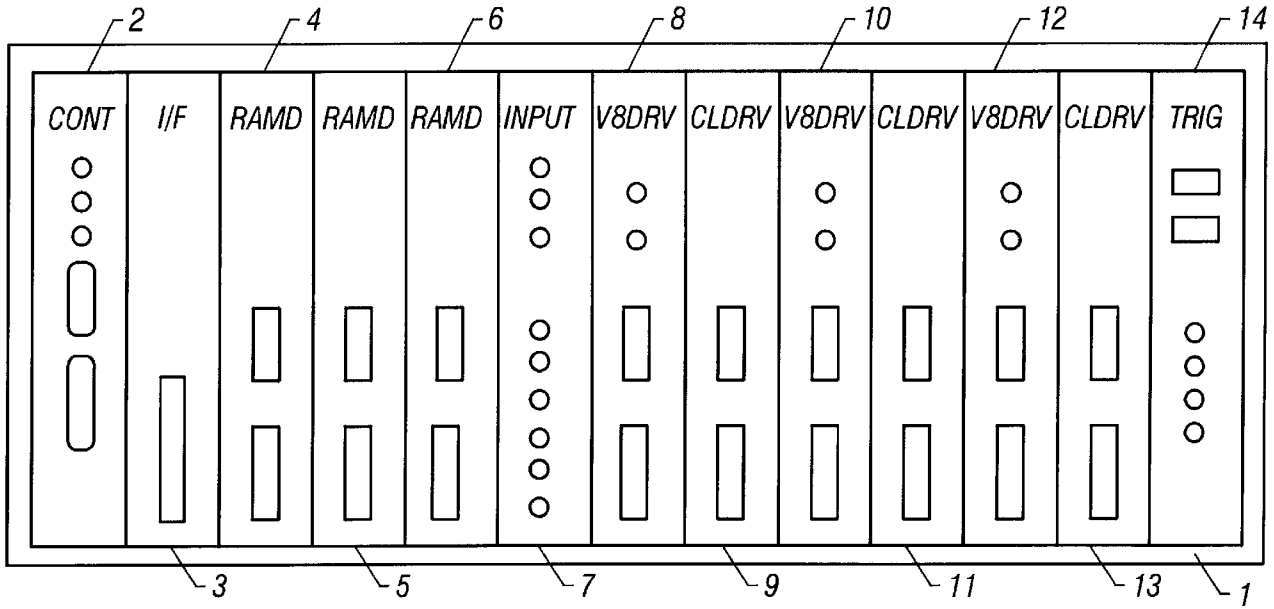
FIG. 1 shows an example of a main frame and modules according to the present invention.
Figure 2:
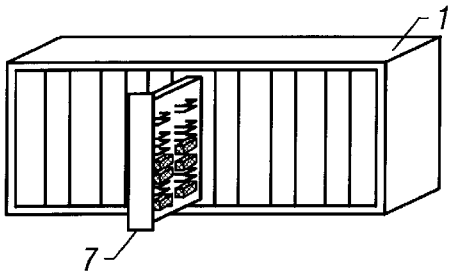
FIG. 2 shows mounting of the modules to the main frame according to the present invention.
Figure 3:
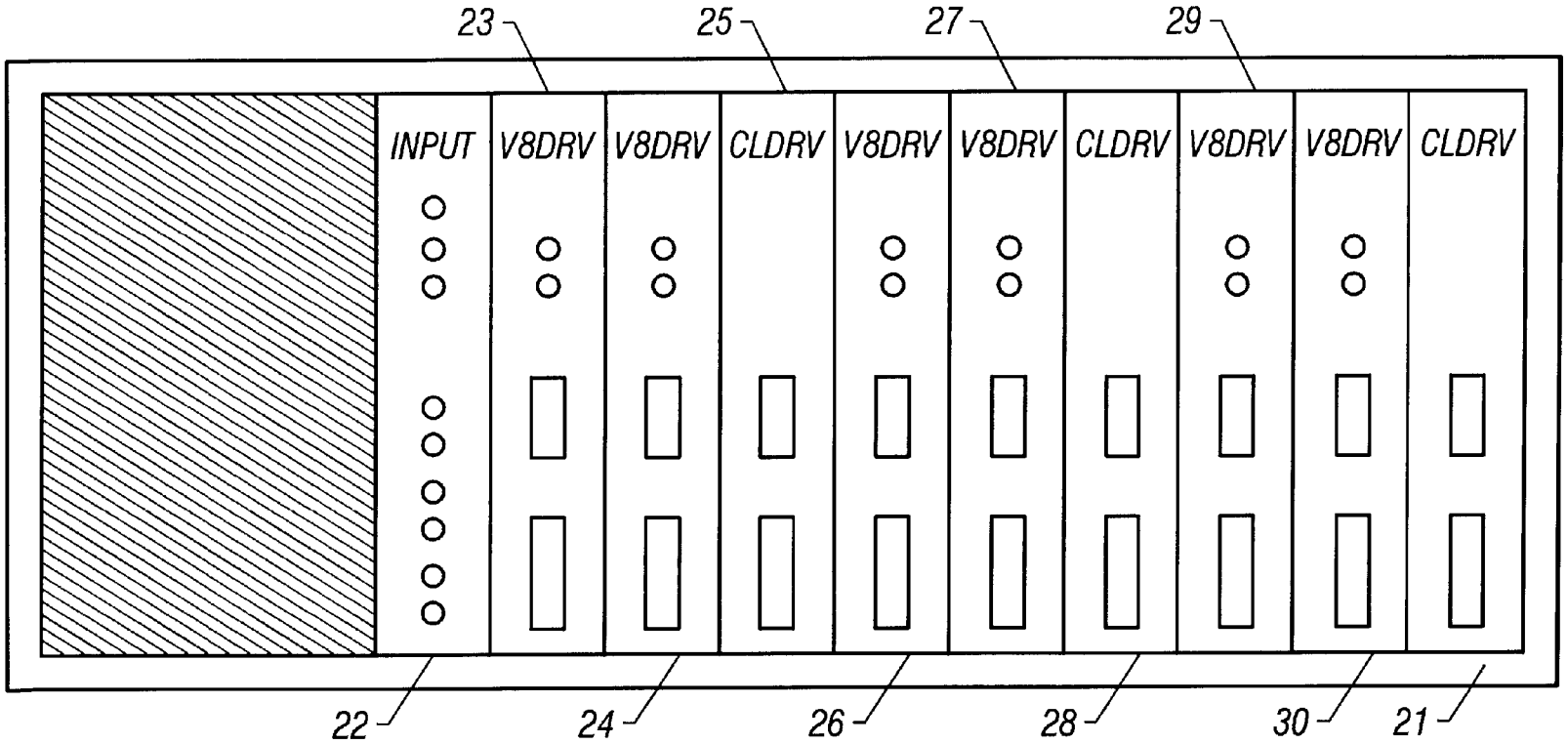
FIG. 3 shows an example of a main frame and modules.

A further detailed explanation will be given of the present invention by showing embodiments as follows.

(Embodiment 1)

According to the present invention, modules are used in accordance with generated drive signals. FIGS. 4A, 4B and 4C show examples of front faces of an input module, an image module and a clock module which are representative modules of the present invention. Naturally, modules may be of types other than these.

As shown by FIG. 4A, the input module is provided with image output terminals 31 through 33 in correspondence with three primary colors, a clock input 34, a horizontal synchronizing input 35, a vertical synchronizing input 36 and image inputs 37 through 39 in correspondence with three primary colors. In the case of a monochromatic signal, an image is inputted to one of the image inputs 37 through 39 and is outputted from one of the image outputs 31 through 33 corresponding thereto. (FIG. 4A)

As shown by FIG. 4B, the image module is provided with an image pass through output terminal 40, an image input terminal 41, a controller input and output terminal 42 and an image output terminal 43. The image pass through output terminal is a terminal for outputting a signal inputted to the module as it is and connecting to other module. The controller input and output terminal is a terminal for connecting to a controller module. Further, an image signal which has been subjected to time division is outputted from the image output terminal. The terminal is constituted by a multiplex pin terminal. (FIG. 4B)

As shown by FIG. 4C, the clock module is provided with a controller output and input terminal 44 and a clock image output terminal 45. Clock signals having different phases are outputted and therefore, the terminal is constituted by a multiplex pin terminal. For example, a basic clock is outputted from a first wiring, a clock the phase of which is shifted by a half period is outputted from a second wiring, a clock the phase of which is shifted by a ¼ period is outputted from a third wiring and a clock the phase of which is shifted by a ¾ period is outputted from a fourth wiring. (FIG. 4C)

Figure 7:
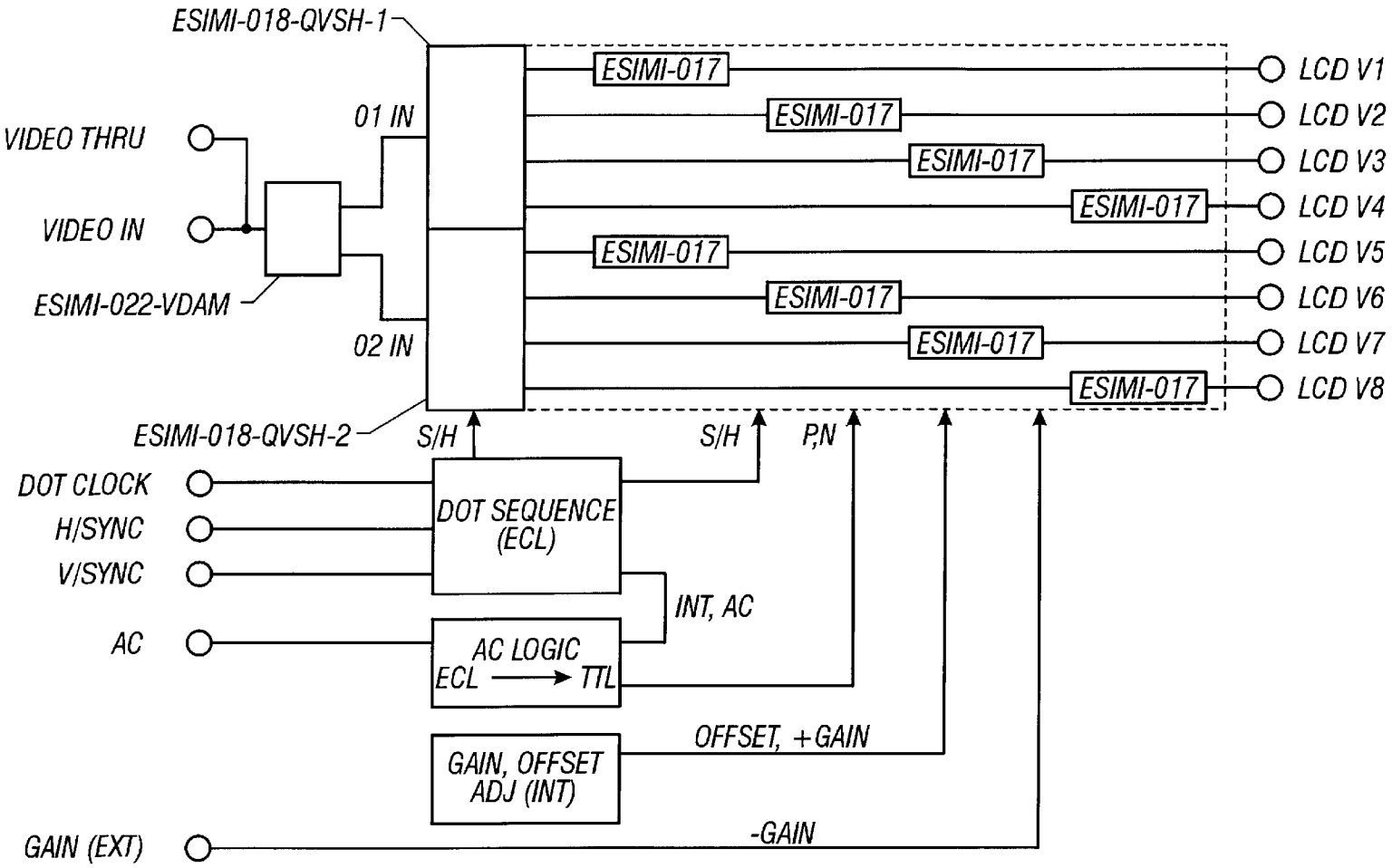
FIG. 7 shows a circuit block diagram of the image module according to Embodiment 1.
Figure 8:
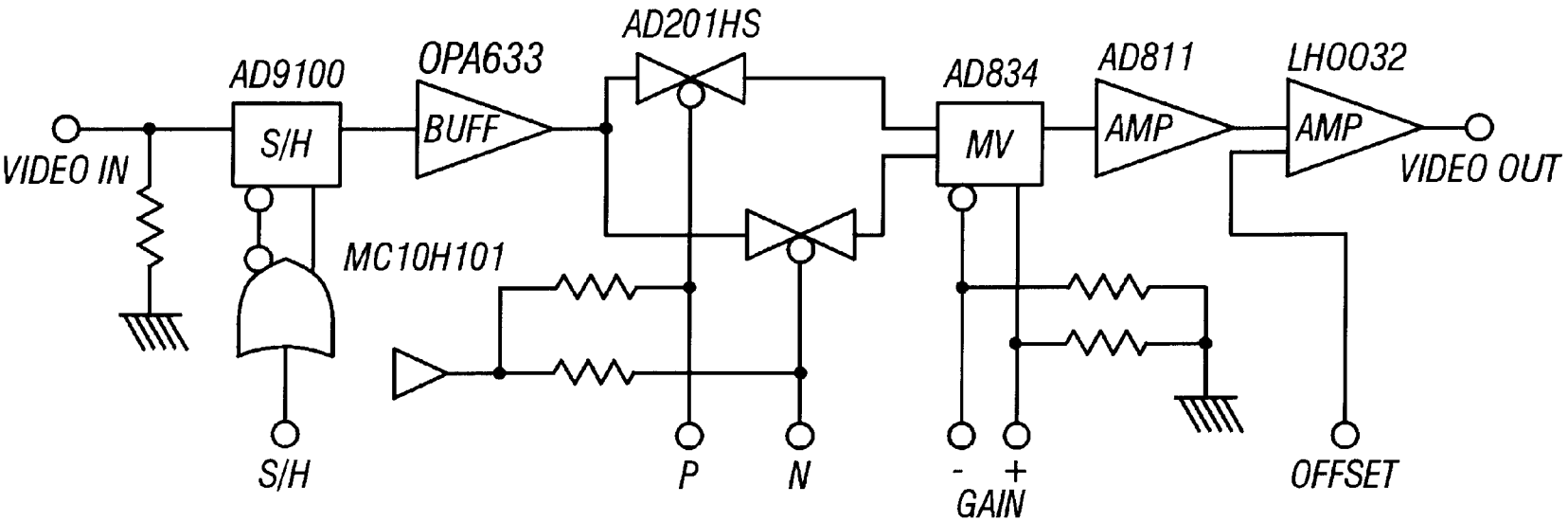
FIG. 8 shows an example of a circuit used in the image module according to Embodiment 1.
Figure 9:
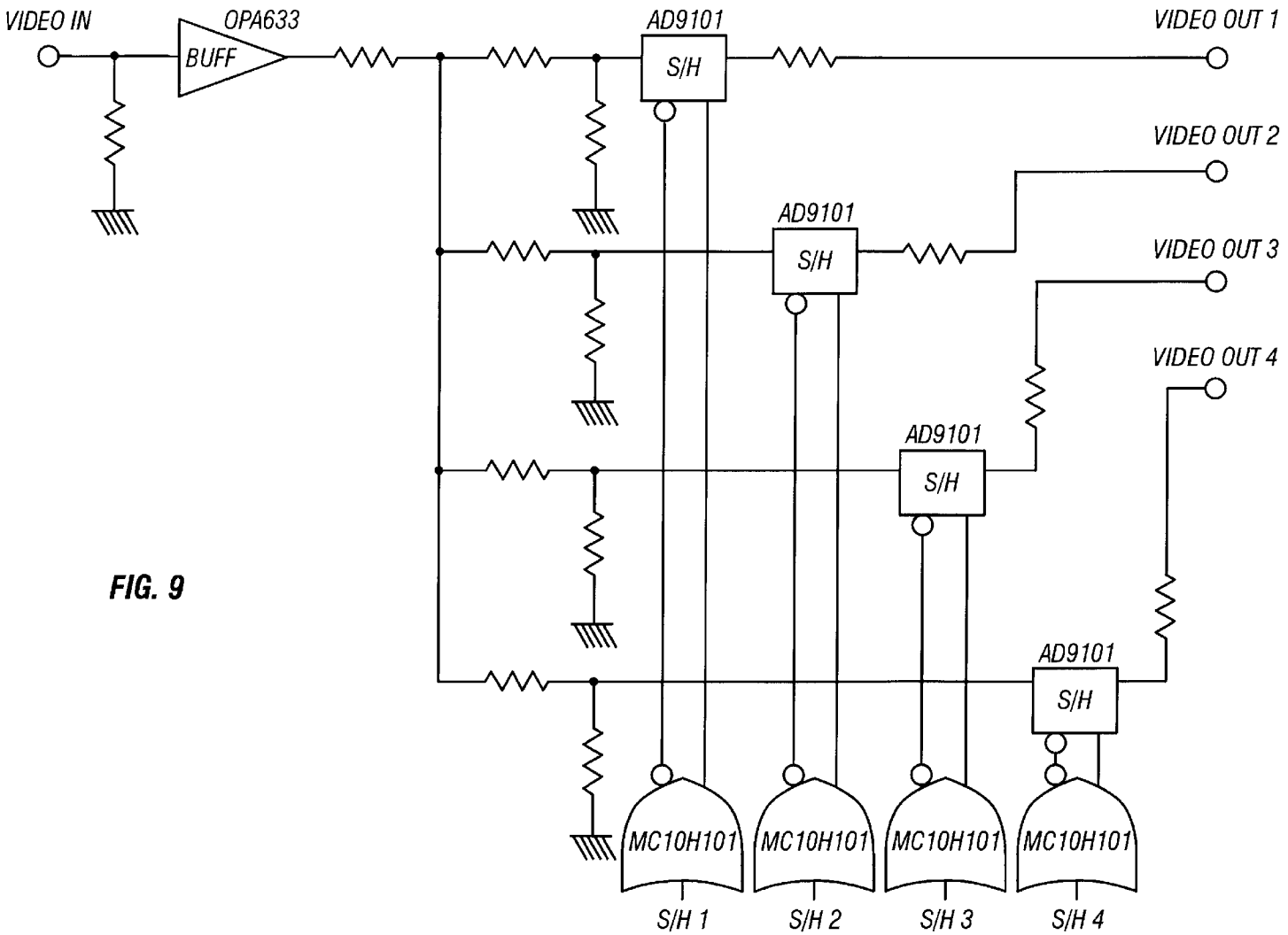
FIG. 9 shows an example of a circuit used in the image module according to Embodiment 1.

FIG. 7 shows circuit blocks of the image module. Among them, the circuit structures of ESIMI-017 and ESIMI-018-QVSH are respectively shown by FIG. 8 and FIG. 9. According to the image module, a video signal is divided in a maximum of 8 in one module. By changing the setting of a dot sequencer circuit, the number of divisions can be changed in a range of 1 through 8. Further, a video signal can be divided into a maximum of 16 by connecting two stages of the image modules and other divisions can be performed by connecting the image modules by 3 stages or more. (FIG. 7 through FIG. 9)

FIG. 5 shows one example of connecting the modules of the present invention in a main frame 51. According to the example, respective one of an input module 52 and a clock module and three of image modules (53 through 55) in correspondence with three primary colors are used. Further, terminals of three primary colors of the input module are connected to the respective image modules. As a result, a number of output wirings is a total of 4 of image output wirings 56, 58 and 59 for three primary colors and a clock output wiring 57.

Figure 10B:
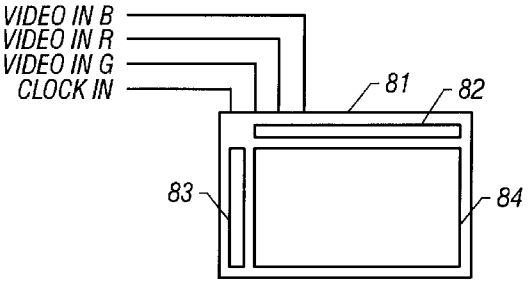
FIG. 10B (Prior Art)
FIGS. 10A and 10B show arrangements of input terminals, drivers and the like of a matrix display device.
Figure 10A:
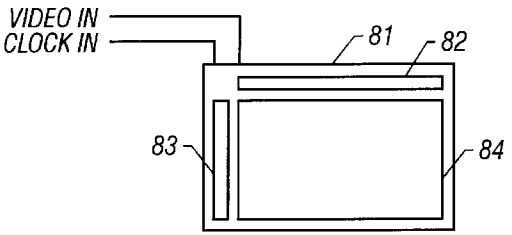
FIG. 10A (Prior Art)
Figure 11B:
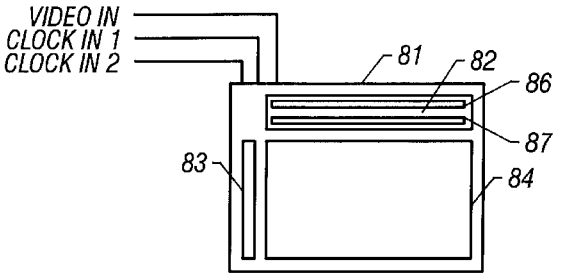
FIG. 11B (Prior Art)
FIGS. 11A, 11B and 11C show arrangements of input terminals, drivers and the like of matrix display devices.
Figure 11A:
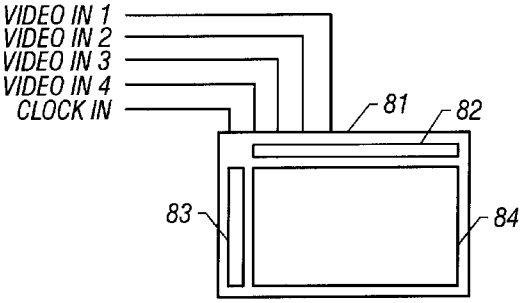
FIG. 11A (Prior Art)
Figure 11C:
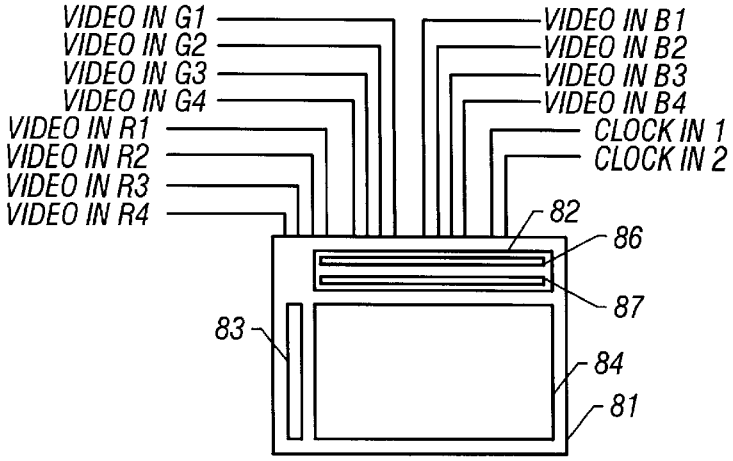
FIG. 11C (Prior Art)
Figure 12:
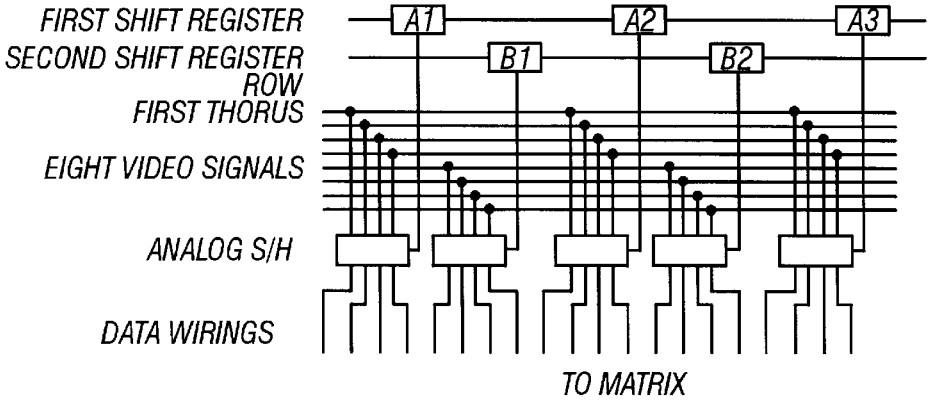
FIG. 12 (Prior Art)
FIG. 12 shows an outline of a data driver circuit of a matrix display device.
Figure 13:
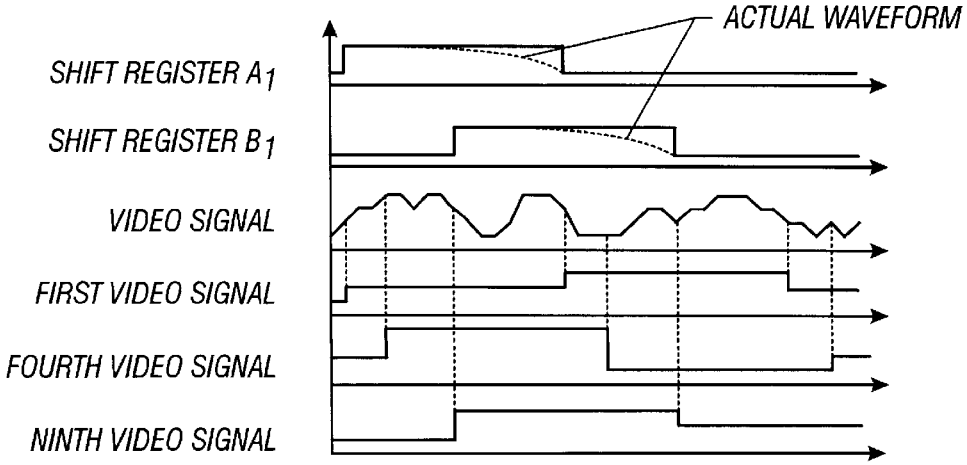
FIG. 13 (PRIOR ART)
FIG. 13 shows an example of signals used in the data drive circuit.

Drive signals which have been processed by the above-described constitution can drive the color display devices shown by FIG. 10B and FIG. 11C. In that case, the setting of the dot sequencer circuit of the image module is changed such that the image is not divided in driving the device of FIG. 10B and such that the image is divided in 4 in driving the display device of FIG. 11C. (FIG. 5)

(Embodiment 2)

Figure 6:
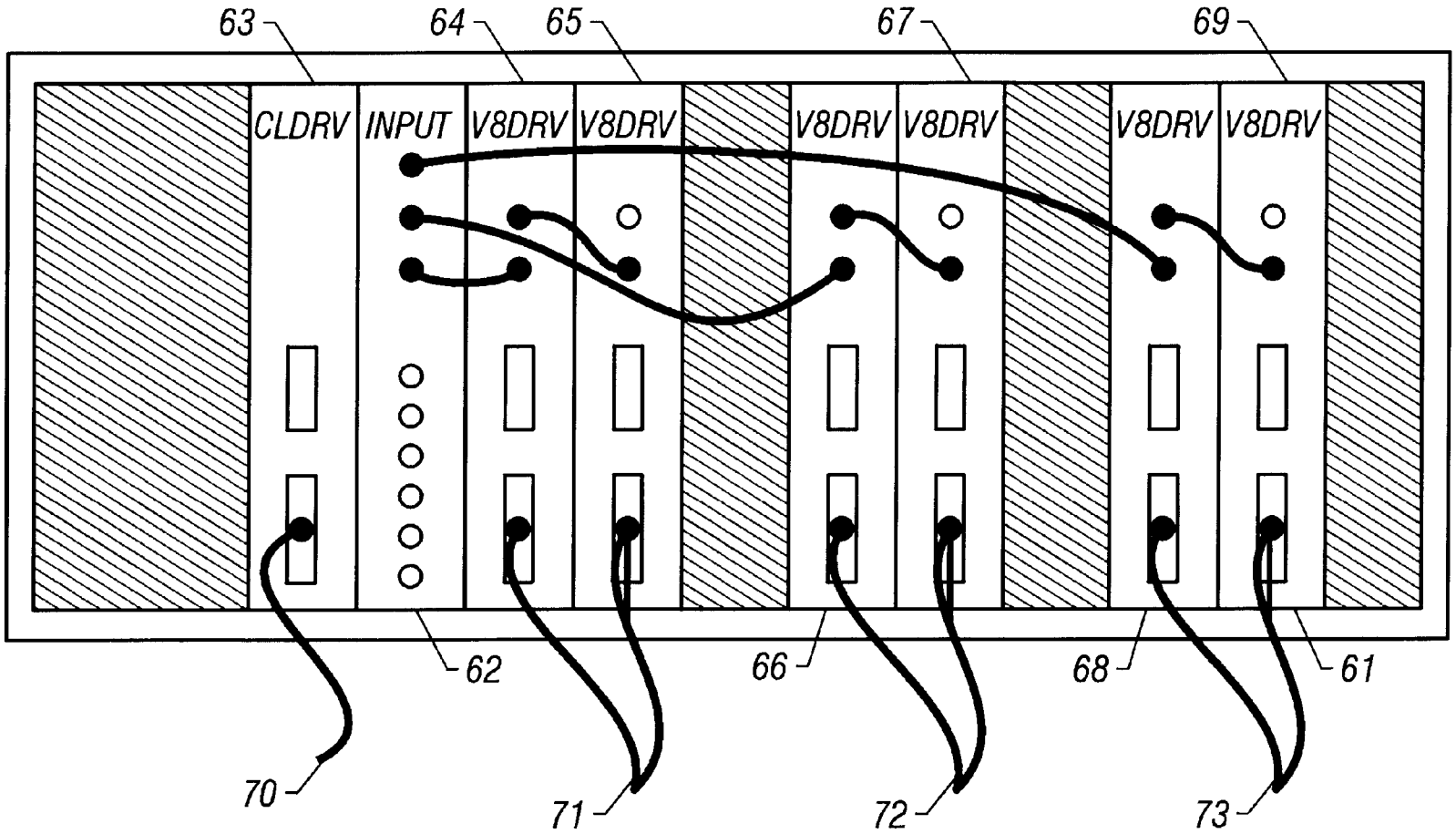
FIG. 6 shows an example of connecting respective modules according to Embodiment 2.

FIG. 6 shows one example of connecting modules of the present invention in a main frame 61. According to the example, respective ones of an input module 62 and a clock module 63 and a total of six image modules (64 through 69) are used. Terminals of three primary colors of the input module are connected to the input modules 64, 66 and 68 among respective image modules. Further, image output pass through terminals of the image modules 64, 66 and 68 are connected to other image modules 65, 67 and 69. This is for dividing an image signal into 16 signals and for that purpose, the setting of dot sequencer circuits of the respective image modules is changed. Output wirings are constituted by a total of 4 routes of image output wirings 71 through 73 of three primary colors and a clock output wiring 70. (FIG. 6)

According to the present invention, signals for driving various systems of matrix display devices can easily be provided by a minimum alteration. As mentioned above, the present invention is industrially useful.

What is claimed is:

1. A device for generating a drive signal of a matrix display device comprising:

a first module for inputting an image signal and a synchronizing signal;

a second module for subjecting the image signal to time division;

a third module for generating a clock signal; and wherein the first through the third modules are independent from each other; and wherein in the second module a number of divisions can arbitrarily be set.

2. A device according to claim 1 wherein said matrix display device is an active matrix display device.

3. A device according to claim 1 wherein said matrix display device is an active matrix liquid crystal display device.

4. A device for generating a drive signal of a matrix display device comprising:

a main frame;

a first module attached to said main frame in a detachable manner for inputting an image signal and a synchronizing signal;

a second module attached said main frame in a detachable manner for subjecting the image signal to time division;

a third module attached to said main frame in a detachable manner for generating a clock signal, wherein each of said first, second and third modules is constituted with a sub-frame and at least one circuit board.

5. A device according to claim 4 wherein said matrix display device is an active matrix display device.

6. A device according to claim 4 wherein said matrix display device is an active matrix liquid crystal display device.

7. A device for generating a drive signal of a matrix display device comprising:

a main frame provided with a bus line;

at least first and second modules attached to said main frame in a detachable manner and electrically connected to said bus line, each of said first and second modules including at least one circuit board and at least one terminal; and a wiring electrically connecting said first and second modules through said terminal to constitute a circuit for generating driving signals of a matrix type display device.

8. A device according to claim 7 wherein said first and second modules are electrically connected to said bus line through connect pins.

9. A device according to claim 7 wherein said matrix type display device is an active matrix type liquid crystal display device.

10. A device according to claim 7 wherein said matrix display device is an active matrix display device.

11. A device according to claim 7 wherein said first and second modules are selected from the group consisting of an input module, an image signal module, a clock signal module, a correction module, an interface module, a control module and a trigger module.

12. A device for generating a drive signal of a matrix display device comprising:

a first module for inputting an image signal and a synchronizing signal;

a second module for subjecting the image signal to time division;

a third module for generating a clock signal; and a fourth module having a different function from said first through said third modules, wherein said first through said fourth modules are independent from each other; and wherein in said second module a number of divisions can arbitrarily be set.

13. A device according to claim 12 wherein said matrix display device is an active matrix display device.

14. A device according to claim 12 wherein said matrix display device is an active matrix liquid crystal display device.

15. A device according to claim 12 wherein said fourth module is selected from the group consisting of a correction module, an interface module, a control module and a trigger module.

16. A device for generating a drive signal of a matrix display device comprising:

a first module for inputting an image signal and a synchronizing signal;

six second modules for subjecting the image signal to time division;

a third module for generating a clock signal; and wherein said first through said third modules are independent from each other; and wherein said image signal is divided into sixteen signals.

17. A device according to claim 16 wherein said matrix display device is an active matrix display device.

18. A device according to claim 16 wherein said matrix display device is an active matrix liquid crystal display device.

19. A device for generating a drive signal of a matrix display device comprising:

a main frame;

a first module attached to said main frame in a detachable manner for inputting an image signal and a synchronizing signal;

six second modules attached said main frame in a detachable manner for subjecting the image signal to time division;

a third module attached to said main frame in a detachable manner for generating a clock signal, wherein each of said first, second and third modules is constituted with a sub-frame and at least one circuit board.

20. A device according to claim 19 wherein said matrix display device is an active matrix display device.

21. A device according to claim 19 wherein said matrix display device is an active matrix liquid crystal display device.

22. A device according to claim 19 wherein said image signal is divided into sixteen signals.

* * * * *